US006018895A

United States Patent [19]

Duppong et al.

[11] Patent Number: 6,018,895

[45] **Date of Patent: *Feb. 1, 2000**

[54] VALVE STACK IN A MINI-EXCAVATOR DIRECTING FLUID UNDER PRESSURE FROM MULTIPLE PUMPS TO ACTUABLE ELEMENTS

[75] Inventors: Gerald J. Duppong; Knute K. Brock; Thomas M. Sagaser, all of Bismark, N. Dak.

[73] Assignee: Clark Equipment Company, Woodcliff Lake, N.J.

[ * ] Notice: This patent is subject to a terminal disclaimer.

[21] Appl. No.: 08/760,435

[22] Filed: Dec. 4, 1996

Related U.S. Application Data

[63] Continuation-in-part of application No. 08/623,168, Mar. 28, 1996, abandoned.

[51] Int. Cl.[7] ..... E02F 5/02

[52] U.S. Cl. ..... 37/348; 60/421; 60/429; 60/424

[58] Field of Search ..... 37/348, 382, 902; 60/421, 428, 429, 424, 426; 91/520, 536, 531; 414/699

[56] References Cited

U.S. PATENT DOCUMENTS

| | | | |
|---|---|---|---|
| 2,322,740 | 6/1943 | Vanderzee et al. | 60/52 |
| 3,146,593 | 9/1964 | Stacey | 60/52 |
| 3,279,637 | 10/1966 | Olson et al. | 214/778 |
| 3,476,274 | 11/1969 | Witmer | 214/138 |
| 3,550,505 | 12/1970 | Byers et al. | 91/411 |
| 3,811,363 | 5/1974 | Cryder | 91/412 |
| 3,910,044 | 10/1975 | Symmank | 60/420 |
| 3,916,624 | 11/1975 | Machens et al. | 60/394 |
| 3,916,767 | 11/1975 | Barton | 91/412 |
| 3,922,855 | 12/1975 | Bridwell et al. | 60/421 |
| 3,960,284 | 6/1976 | Carpenter | 60/421 X |
| 4,023,364 | 5/1977 | Bianchetta | 60/421 |
| 4,024,710 | 5/1977 | Zelle | 60/420 |
| 4,030,623 | 6/1977 | Bridwell et al. | 214/138 R |
| 4,055,046 | 10/1977 | Schexnayder | 60/428 |
| 4,078,681 | 3/1978 | Field, Jr. | 214/138 R |
| 4,080,994 | 3/1978 | Flaschar et al. | 137/596.13 |
| 4,171,054 | 10/1979 | Tanaka et al. | 414/687 |
| 4,210,061 | 7/1980 | Bianchetta | 91/6 |

(List continued on next page.)

FOREIGN PATENT DOCUMENTS

| | | |
|---|---|---|
| 0717198 A2 | 6/1996 | European Pat. Off. . |
| 0798422 A2 | 10/1997 | European Pat. Off. . |
| 2193156 | 2/1974 | France . |
| 58-146631 | 2/1982 | Japan . |
| 57184137 | 11/1982 | Japan . |
| 60164522 | 2/1984 | Japan . |
| 01320302 | 12/1989 | Japan . |

OTHER PUBLICATIONS

"Maximising Mini Excavator Performance", *Industrial Vehicle Technology* '1995.

"Hydraulic Excavators From Melroe", *Worksaver* Magazine, Fall 1986, p. 23.

*Primary Examiner*—Thomas B. Will
*Assistant Examiner*—Victor Batson
*Attorney, Agent, or Firm*—Westman, Champlin & Kelly, P.A.

[57] ABSTRACT

A power machine includes a pair of traction motors to provide for travel of the machine. The power machine also includes a boom, an arm and a tool (such as a bucket). The power machine includes a hydraulic power circuit which has a valve stack that enables the boom and at least one of the arm and tool to be operated simultaneously.

20 Claims, 9 Drawing Sheets

U.S. PATENT DOCUMENTS

| | | | |
|---|---|---|---|
| 4,256,142 | 3/1981 | Hancock | 137/596 |
| 4,343,151 | 8/1982 | Lorimor | 60/422 |
| 4,354,420 | 10/1982 | Bianchetta | 60/421 X |
| 4,365,429 | 12/1982 | Ecker et al. | 37/348 X |
| 4,526,085 | 7/1985 | Morizur et al. | 91/6 |
| 4,528,892 | 7/1985 | Okabe et al. | 91/520 X |
| 4,561,249 | 12/1985 | Watanabe et al. | 60/421 |
| 4,561,341 | 12/1985 | Aikawa | 91/6 |
| 4,570,441 | 2/1986 | Yoshida et al. | 60/421 |
| 4,622,886 | 11/1986 | Imada et al. | 91/520 |
| 4,768,339 | 9/1988 | Aoyagi et al. | 60/427 |
| 4,961,371 | 10/1990 | Takashima | 91/530 |
| 4,986,072 | 1/1991 | Kubomoto | 60/421 |
| 5,081,837 | 1/1992 | Ueno | 60/421 |
| 5,081,838 | 1/1992 | Miyaoka et al. | 37/348 X |
| 5,083,428 | 1/1992 | Kubomoto et al. | 60/421 |
| 5,335,494 | 8/1994 | Benko et al. | 60/428 |
| 5,392,539 | 2/1995 | Hirata et al. | 37/348 |
| 5,434,785 | 7/1995 | Myeong-Hun et al. | 37/902 X |
| 5,446,979 | 9/1995 | Sugiyama et al. | 37/348 |
| 5,471,908 | 12/1995 | Lech | 60/424 X |

VALVE STACK IN A MINI-EXCAVATOR DIRECTING FLUID UNDER PRESSURE FROM MULTIPLE PUMPS TO ACTUABLE ELEMENTS

REFERENCE TO CO-PENDING APPLICATION

This application is a continuation-in-part of application Ser. No. 08/623,168 filed Mar. 28, 1996, now abandoned, entitled MULTIFUNCTION VALVE STACK, and assigned to the same assignee as the present invention.

BACKGROUND OF THE INVENTION

The present invention deals with power machines. More particularly, the present invention deals with an arrangement of valves in a power machine to provide multiple functions.

Mini-excavators are currently in wide use. Such excavators typically have a base portion which is supported by a pair of track assemblies. The track assemblies are powered by hydraulic motors.

The base portion typically supports a house, or operator support portion. The house is rotatable relative to the base portion. Rotation is powered by a hydraulic slew motor. Mini-excavators also typically have a number of other features. For example, a boom is typically coupled to the house. A power actuator, such as a hydraulic cylinder, is coupled to the boom to pivot the boom relative to the house about an arc substantially located in a vertical plane. The boom is also typically pivotable substantially in a horizontal plane. This type of pivoting movement is accomplished through the use of a hydraulic cylinder (referred to as an offset cylinder) coupled to the house and to the boom.

An arm is coupled to a distal end of the boom, and is also typically pivotable relative to the boom through use of a hydraulic cylinder. A tool is commonly coupled to the end of the arm and is manipulated, also through the use of a hydraulic cylinder. Such a tool may typically be a bucket pivotally coupled to the arm.

Also, a blade is commonly mounted to the base portion. The blade can be raised, and lowered, by actuating a hydraulic cylinder. Other functions, such as auxiliary functions are also common.

While many hydraulic functions may be provided on the mini-excavator, there are typically four primary functions performed by the mini-excavator. The first is actuation of the bucket (or tool), the second is actuation of the arm, the third is actuation of the boom, and the fourth is operating the slew motor.

In prior excavators, the valves controlling these four hydraulic functions were placed in parallel with one another. Because of this parallel arrangement, if any of the functions were actuated simultaneously, the function requiring the least pressure obtained substantially all of the hydraulic fluid flow. Therefore, if two functions were actuated simultaneously, such as lifting the boom out of a hole, after the bucket is full of dirt, and rotating the cab (or house) the higher pressure of those functions would substantially stop while the other function was being performed.

Also, in prior excavators, it has been observed that two of the functions performed by the mini-excavator can tend to be more time consuming than the other functions. One of the time consuming functions is raising the boom, particularly when the bucket is filled with dirt or another heavy substance. The boom cylinder is generally quite a large cylinder and takes a great deal of hydraulic fluid for actuation. Providing enough hydraulic flow to the hydraulic actuator raising the boom can take significant time.

The other function which can be time consuming is traveling in the excavator. It has been conventional wisdom that hydraulic power supplied to the traction motors to move the excavator should be substantially separated from power provided to perform other functions in the hydraulic circuit. In other words, it has been thought advantageous to provide the traction motor hydraulic fluid in its own hydraulic circuit substantially separate from the circuit which provides hydraulic fluid to the remainder of the functions.

Also, prior excavators have been configured to provide multiple travel speeds. However, prior systems have provided this multiple speed function by providing a dual-displacement traction motor, which is quite expensive. Such a motor provides a different output speed, but at a lower torque.

SUMMARY OF THE INVENTION

A power machine includes a pair of traction motors to provide for travel of the machine. The power machine also includes a boom, an arm and a tool (such as a bucket). The power machine includes a hydraulic power circuit which has a valve stack that enables the boom and at least one of the arm and tool to be operated simultaneously, and during travel of the power machine.

DETAILED DESCRIPTION OF THE PREFERRED EMBODIMENTS

Figure 1:
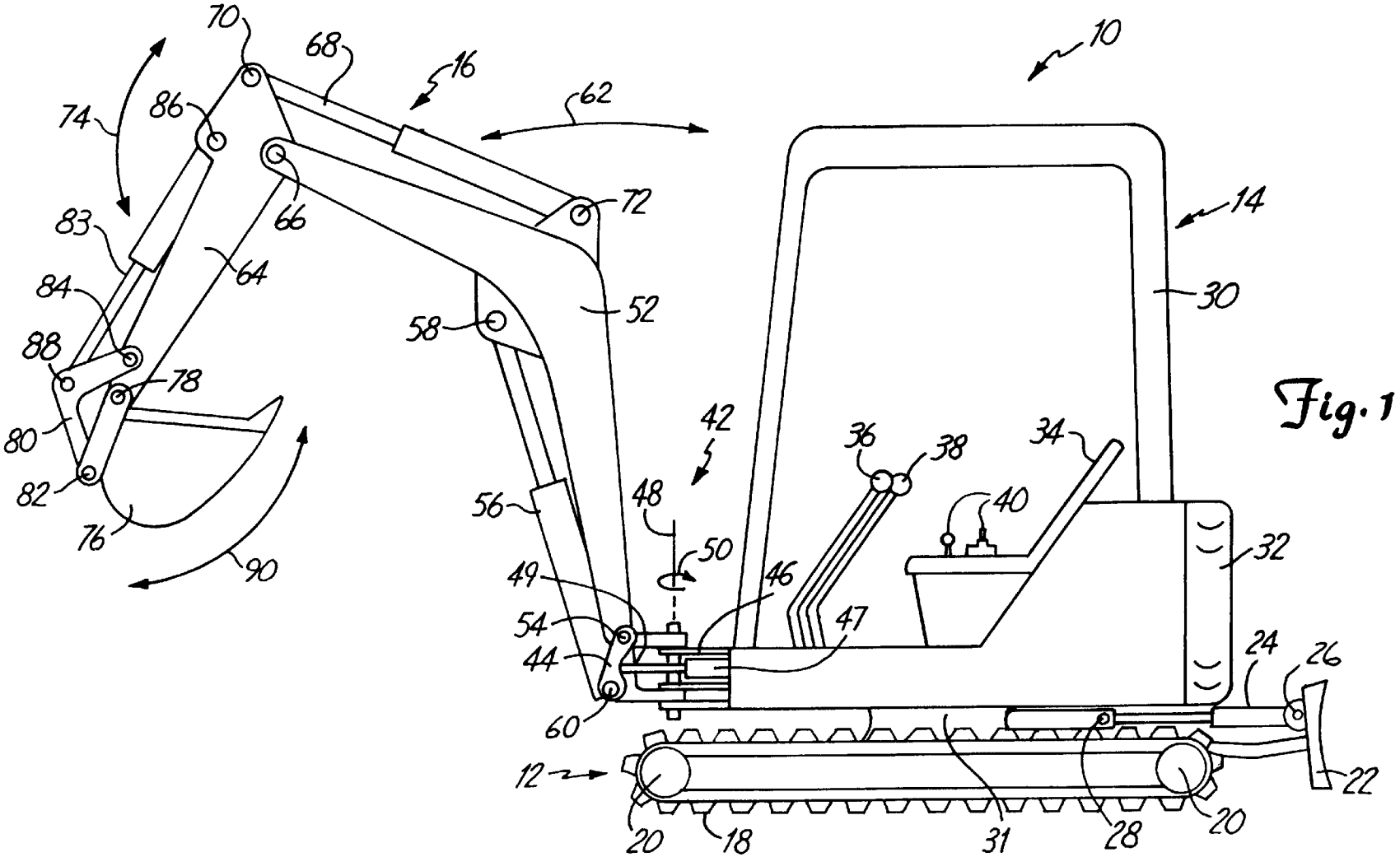
FIG. 1 is a side view of a mini-excavator according to the present invention.

FIG. 1 is a side view of a mini-excavator 10 according to the present invention. Mini-excavator 10 includes a base portion 12, an operator support portion (or house) 14, and a dipper assembly 16. Base portion 12 includes a frame (not shown) and a pair of tracks 18. Only one track 18 is shown in FIG. 1, and it will be appreciated that the second track 18 is identically, and oppositely, disposed on the other side of mini-excavator 10.

Tracks 18 are rotatable about a pair of hubs 20. At least one of hubs 20 is driven by a hydraulic motor 114, 116 (shown in FIGS. 3 and 4). In the preferred embodiment, each track 18 is driven by a separate hydraulic travel motor to provide travel. The travel motors are controlled by the operator through manipulation of suitable controls in house 14.

Base portion 12 also includes a blade 22 which is pivotally coupled to the frame of base portion 12. Blade 22 is also pivotally coupled to a hydraulic cylinder 24 at pivot point 26. Hydraulic cylinder 24 is pivotally coupled to the frame of base portion 12 at pivot point 28. Hydraulic cylinder 24 is selectively provided with hydraulic fluid under pressure from a hydraulic power circuit which is described in greater detail later in the specification. The operator, upon the manipulation of appropriate controls, can raise and lower blade 22 by causing selective retraction and extension of hydraulic cylinder 24.

Operator support portion 14 includes a cab 30 which is rotatably coupled to the frame of the base portion 12 by a swivel joint 31. Cab 30 typically includes an engine compartment 32, a seat 34 for supporting the operator, and a plurality of hand controls for controlling mini-excavator 10. In the preferred embodiment, the hand controls include a pair of steering levers 36 and 38, and a number of joysticks 40.

Steering levers 36 and 38 are manipulated by the operator to steer mini-excavator 10. For example, pushing forward on lever 36 causes the hydraulic motor associated with lever 36 to drive the corresponding track 18 in the forward direction. Pulling back on lever 36 causes the hydraulic motor associated with lever 36 to drive the corresponding track 18 in the reverse direction. The same is true of lever 38 and its associated hydraulic motor. Joysticks 40 are preferably used by the operator to control other hydraulic actuators on mini-excavator 10.

Dipper assembly 16 is pivotally coupled to operator support portion 14 at joint 42. Dipper assembly 16 includes a bracket 44 which is pivotally mounted to a corresponding bracket 46 on operator support portion 14. Bracket 44 is pivotally mounted to pivot about an axis represented by numeral 48 and generally in a direction indicated by arc 50. It will be appreciated that arc 50 designates pivotal movement into and out of the page of FIG. 1 about axis 48. An offset cylinder 47 is mounted to operator support portion 14 and is pivotally mounted at pivot point 49 to bracket 44. As the operator controls the extension and retraction of offset cylinder 47, dipper assembly 16 is controlled to pivot through arc 50, about axis 48, into and out of the page of FIG. 1.

Dipper assembly 16 also includes a boom 52. Boom 52 is pivotally coupled to bracket 44 at pivot point 54. Boom 52 is also pivotally coupled to a hydraulic cylinder 56 at pivot point 58. Hydraulic cylinder 56 is, in turn, pivotally coupled to the bracket 44 at pivot point 60. Thus, as the operator controls the extension and retraction of hydraulic cylinder 56, boom 52 is raised and lowered through an arc 62 generally defined by a vertical plane.

Dipper assembly 16 also includes an arm 64 which is pivotally coupled to boom 52 at pivot point 66. Arm 64 is also pivotally coupled to a hydraulic cylinder 68 at pivot point 70. Hydraulic cylinder 68 is, in turn, pivotally coupled to boom 52 at pivot point 72. Thus, as the operator controls the extension and retraction of hydraulic cylinder 68, arm 64 pivots relative to boom 52 through an arc 74 and generally about pivot point 66.

Mini-excavator 10 also typically has a tool, such as bucket 76, coupled to the distal end of arm 64. Bucket 76 is pivotally coupled to arm 64 at pivot point 78. Bucket 76 is also pivotally coupled to a mounting bracket 80 at pivot point 82. Mounting bracket 80, in turn, is pivotally coupled to arm 64 at pivot point 84. A hydraulic cylinder 83 is also pivotally coupled to arm 64 at pivot point 86, and to mounting bracket 80 at pivot point 88. Thus, as the operator controls the extension and retraction of hydraulic cylinder 83, bucket 76 pivots generally through an arc 90 about pivot point 78.

It will be appreciated that the actuation of certain of the hydraulic motors or hydraulic actuators in mini-excavator 10 will require greater or lesser hydraulic pressure than others, depending upon the specific hydraulic motor or hydraulic actuator being actuated. For instance, the actuation of hydraulic cylinder 56, in order to extend hydraulic cylinder 56 and raise boom 52, may take a great deal of pressure, specifically if boom 52 is lifting bucket 76 out of a hole wherein bucket 76 is completely filled with dirt or another heavy substance. By contrast, the actuation of offset cylinder 47 to pivot dipper assembly 16 about axis 48 may take only a small amount of pressure, even if bucket 76 is full. Of course, offset cylinder 47 can take a great deal of pressure if the operator support portion is also being slewed, due to the requirement of overcoming certain inertial force components.

Figure 2A:
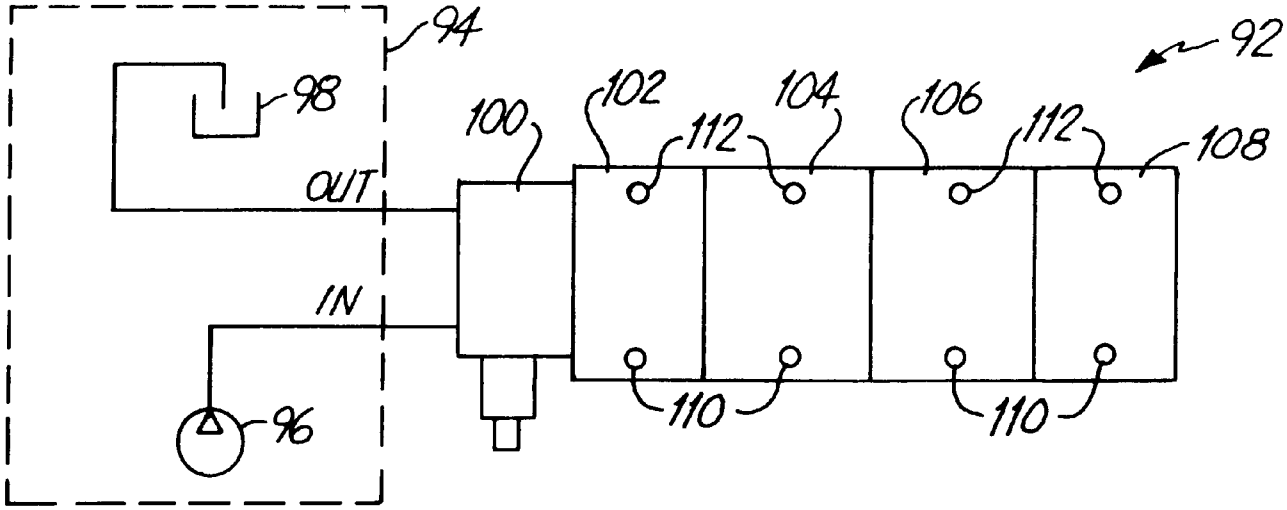
Fig. 2A (PRIOR ART)
FIG. 2A is a block diagram of a valve stack according to the prior art.

FIG. 2A shows a portion of a hydraulic circuit (in simplified block diagram form) of a prior mini-excavator. FIG. 2A shows a valve stack 92 coupled to a hydraulic fluid supply circuit 94. Hydraulic fluid supply circuit 94 is shown in greatly simplified form and includes pump 96 and tank or reservoir 98. Valve stack 92 includes relief valve 100, and a plurality of hydraulic actuator valves 102, 104, 106 and 108. Valve 102 is a slew valve which controls the flow of hydraulic fluid to the slew motor that causes rotation of operator support portion 14 about base portion 12. Valve 104 is a blade valve which controls the flow of hydraulic fluid to hydraulic cylinder 24 in order to manipulate blade 22. Valve 106 is a bucket valve that controls the flow of hydraulic fluid to hydraulic cylinder 83 in order to manipulate the position of bucket 76. Hydraulic valve 108 is an offset valve which controls the flow of hydraulic fluid to hydraulic cylinder 47 in order to control the position of dipper assembly 16 about axis 48. Relief valve 100 is typically configured to dump hydraulic fluid under pressure from pump 96 to tank 98 when the pressure at the inputs of valves 102–108 exceeds the threshold pressure (typically 2500 psi).

Each of valves 102–108 has an inlet port 110 which receives hydraulic fluid under pressure from pump 96 and an outlet port 112 which is coupled to provide the hydraulic fluid return to tank 98. In typical prior mini-excavators, valve stack 92 was configured so that valves 102–108 were connected in parallel with one another. In other words, the valves 102–108 were all connected to one another and to the input line from pump 96 by a common chamber. Similarly, the valves were all connected to one another and to the output line coupled to tank 98 by a common chamber.

Therefore, if two of the hydraulic functions which were controlled by any of valves 102–108 were simultaneously requested, and spools in those valves were moved from a neutral position to a work position (wherein hydraulic fluid is provided from pump 96 through an inlet 110), the function or hydraulic actuator which actually received the hydraulic fluid under pressure depended upon the pressure requirements of the two functions which were simultaneously requested. As indicated previously, in a parallel valve configuration, the lowest pressure function typically receives substantially all of the hydraulic fluid flow from pump 96, and the higher pressure function typically receives very little, if any, of the hydraulic fluid flow. Therefore, in an example in which slew valve 102 is actuated along with offset valve 108, the slew motor receives substantially all of the hydraulic fluid flow, and the offset actuator 47 receives substantially none of the hydraulic fluid flow. This is because under simultaneous movement of the slew motor and the offset cylinder, inertial force components can act to oppose movement of the offset cylinder such that the amount of pressure required to rotate operator support portion 14 relative to base 12 is significantly less than the amount of pressure required to pivot dipper assembly 16 about axis 48.

This has the effect of precluding the operator from being able to pivot dipper assembly 16 until the operator support portion 14 is rotated to a desired position so that the operator can again move slew valve 102 to the neutral position. Further, if the operator is pivoting dipper assembly 16 and then simultaneously actuates slew valve 102, rotation of dipper assembly 16 stops and operator support portion 14 is rotated to its desired position. Only after this occurs and the slew valve 102 is again returned to the neutral position does the offset cylinder again receive hydraulic fluid under pressure and continue to rotate dipper assembly 16.

Figure 2B:
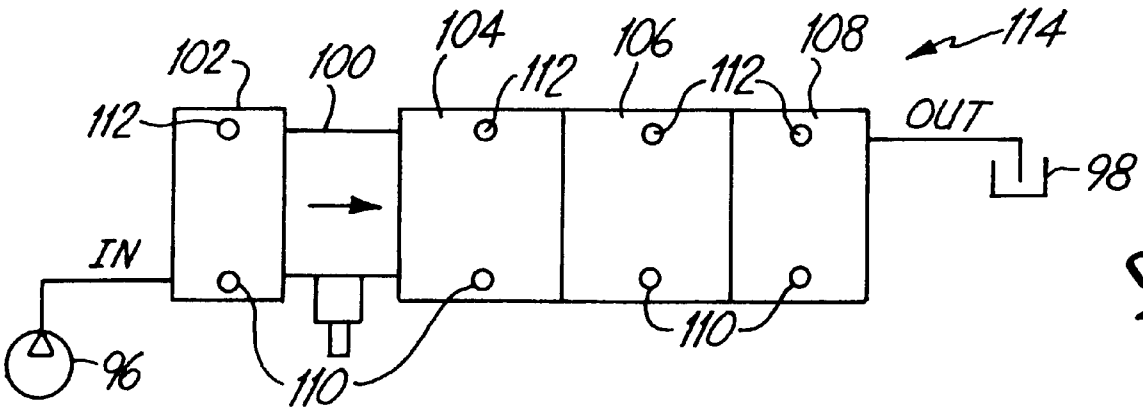
FIG. 2B is a block diagram of one embodiment of a valve stack according to the present invention.

FIG. 2B shows a valve stack 114 according to the present invention in simplified block diagram form. Valve stack 114 contains substantially all of the same components as valve stack 92, and those components are similarly numbered. However, the components are configured differently in valve stack 114 than in valve stack 92. Specifically, valve stack 114 has valves 104, 106 and 108 coupled in parallel with one another, while slew valve 102 is coupled in series with the parallel combination of valves 104, 106 and 108. Also, relief valve 100 is moved downstream of valve 102.

Figure 3A:
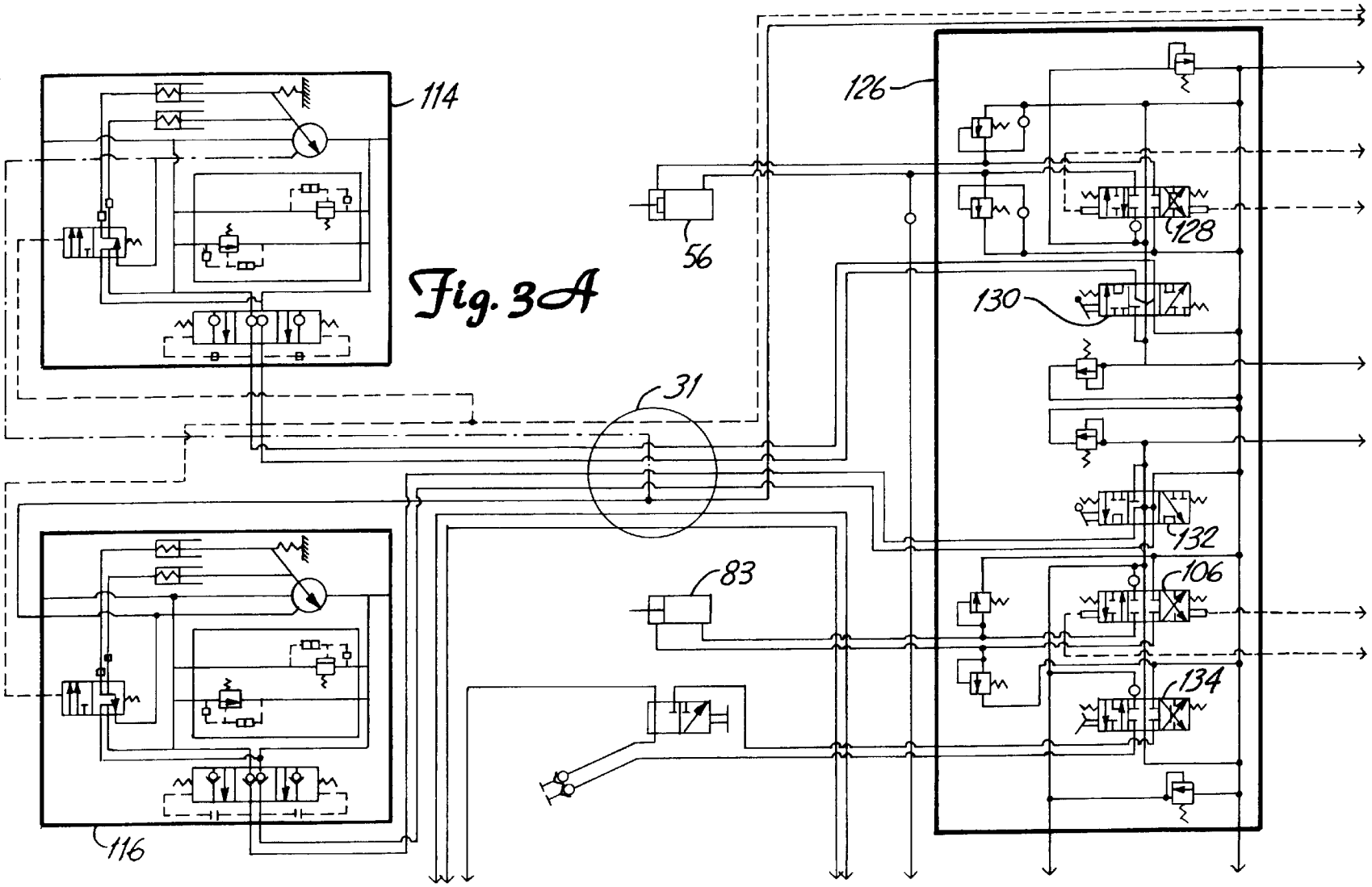
FIG. 3 is a more detailed schematic diagram of one embodiment of a hydraulic system according to the present invention.
Figures 3, 3B:
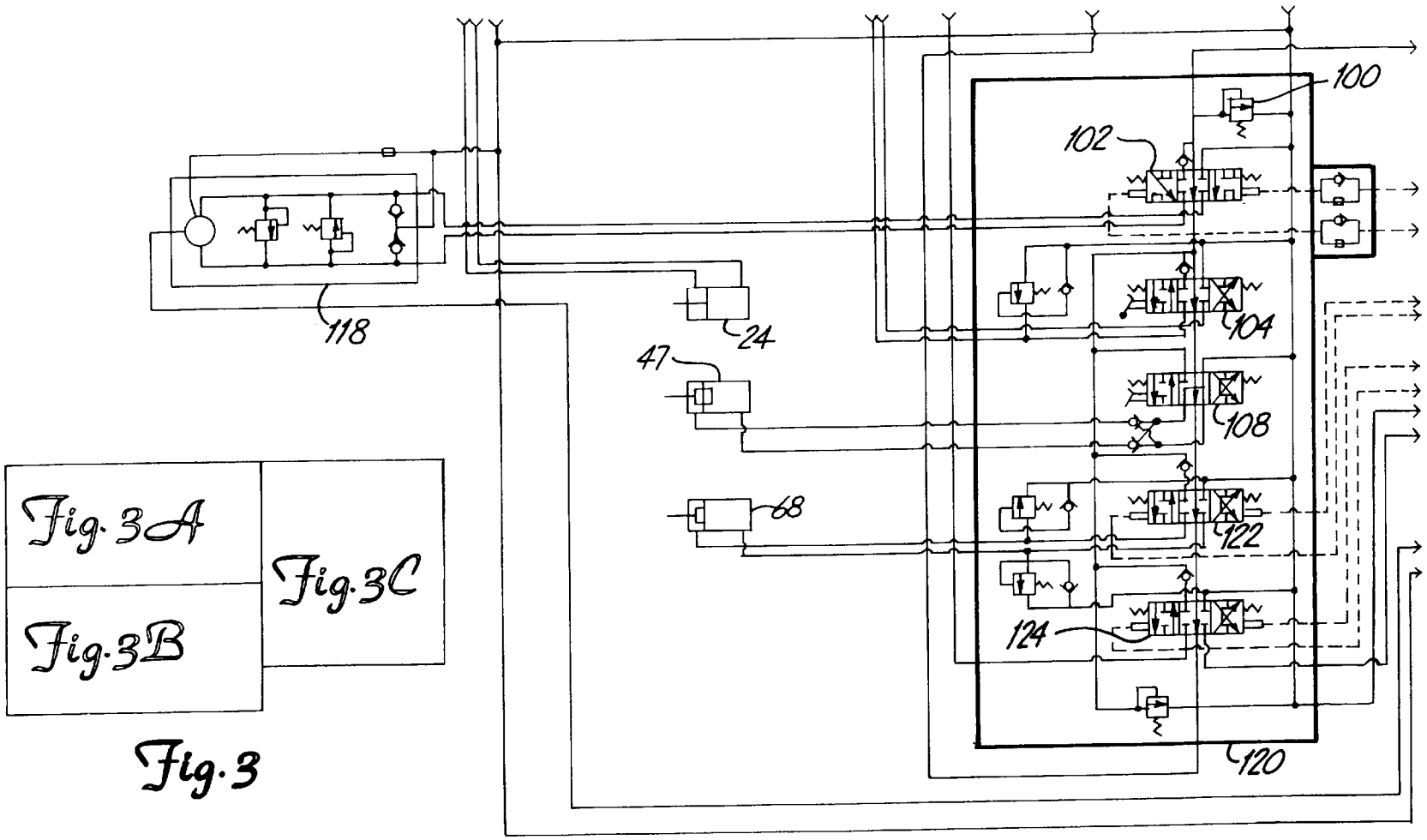
Figure 3C:
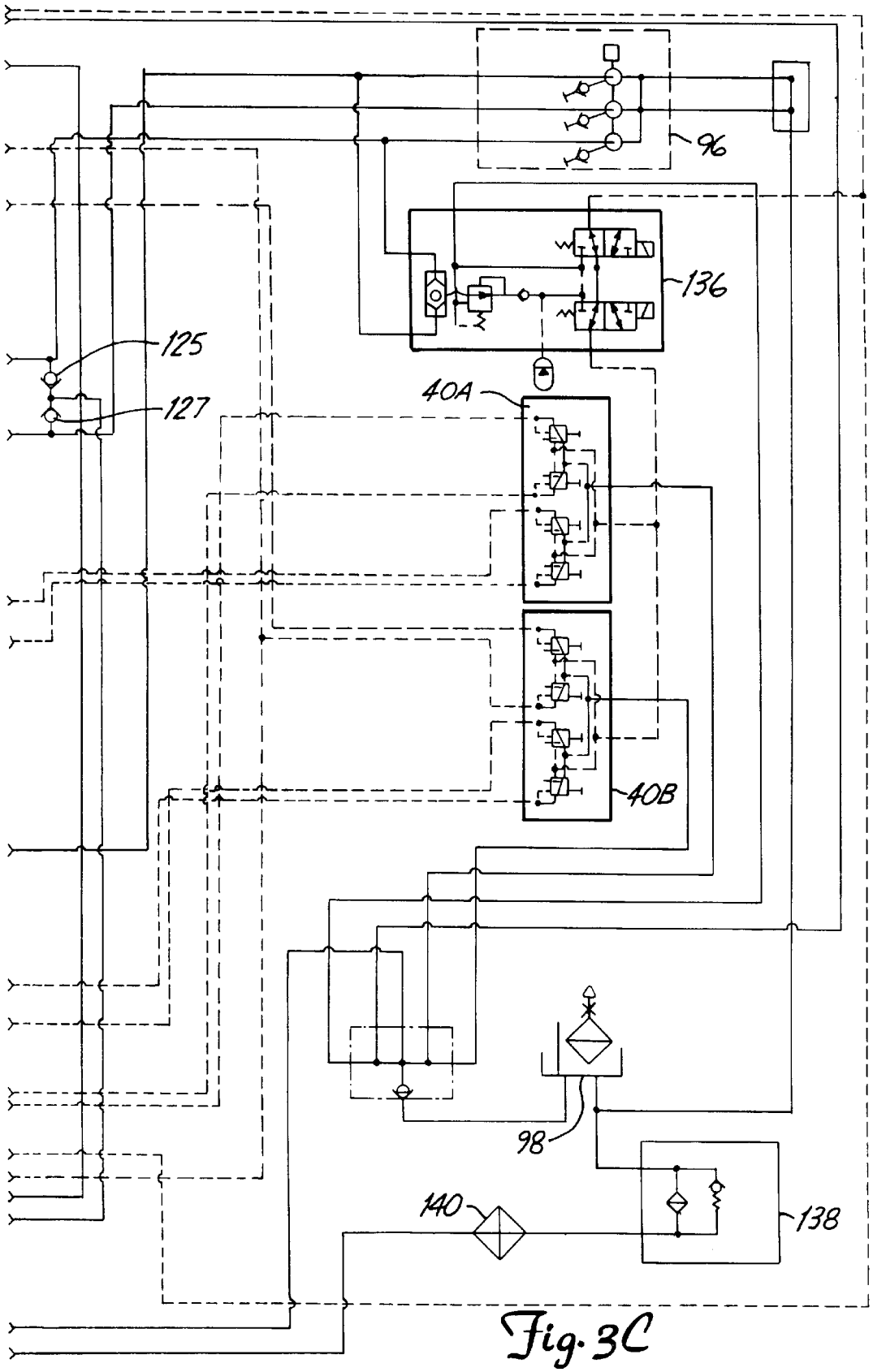

Since the slew motor, which is described in greater detail with respect to FIG. 3, is a hydraulic motor, instead of a hydraulic cylinder, hydraulic fluid which is provided to the slew motor through valve 102 is circulated through the slew motor and is returned to valve 102. Therefore, any hydraulic fluid under pressure which is diverted to the slew motor through valve 102 is returned to valve 102 and is provided downstream to the remainder of valves 104–108. Rather than having outlet port 112 of valve 102 plumbed directly to tank 98, the outlet port 112 is provided to the inlet ports 110 of valves 104, 106 and 108, since valves 104, 106 and 108 are connected in parallel with one another.

The effect of this is that the operator can now perform the slew function controlled by valve 102 along with any one of the other hydraulic functions controlled by valves 104, 106 or 108. For example, if the operator is slewing the operator support portion 14, all of the hydraulic fluid provided to the slew motor is returned to valve stack 114 and also provided to the parallel combination of valves 104, 106 and 108. Therefore, that hydraulic fluid under pressure is still available to perform any of the hydraulic functions performed by those downstream valves. Similarly, if the operator is actuating any of the cylinders controlled by valves 104, 106 and 108, and then wants to slew operator support portion 14, the operator can do so substantially without interruption to either the slew operation or the other hydraulic operation previously performed.

In the preferred embodiment, slew motor 102 is provided with its own cross-port relief valves. Therefore, relief valve 100 can be moved downstream of slew valve 102 without jeopardizing the integrity of the relief system in the hydraulic power circuit. Even in the instance in which the cross-port relief valves in the hydraulic slew motor are actuated, the hydraulic fluid under pressure is simply diverted to the low pressure side of the hydraulic slew motor, and the hydraulic fluid is returned to valve 102 and provided downstream to the remainder of valves 104–108.

It should also be noted that while valves 102, 104, 106 and 108 are depicted in FIG. 2B as control valves for controlling the slew motor, the blade cylinder, the bucket cylinder and the offset cylinder, the valves can be assigned to control any appropriate or desired hydraulic functions on mini-excavator 10.

FIG. 3 is a more detailed schematic diagram of a hydraulic power circuit according to the present invention. The power circuit shown in FIG. 3 includes right hand hydraulic travel motor 114, left hand hydraulic travel motor 116, and slew motor 118. FIG. 3 shows blade cylinder 24, boom offset cylinder 47, boom cylinder 56, arm cylinder 68 and bucket cylinder 83 and those items are similarly numbered to those shown in FIG. 1. The relief valve 100, slew valve 102, blade valve 104, bucket valve 106 and boom offset valve 108 are also shown and are similarly numbered to those elements shown in FIG. 2B. However, in FIG. 3, valves 100, 102, 104, 106 and 108 are slightly reconfigured. In the embodiment shown in FIG. 3, valves 100, 102, 104 and 108 are in a valve stack 120, along with arm valve 122 which is utilized to control arm cylinder 68, and boost valve 124 which will be described in greater detail later in the specification.

A second valve stack 126 includes bucket valve 106, boom valve 128 which is used to control boom cylinder 56, right hand travel valve 130 which is used to control right hand travel motor 114, left hand travel valve 132 which is used to control left hand travel motor 116, and an auxiliary valve 134 which is used to control one of any number of auxiliary components which can be coupled to valve 134. All of the valves shown in FIG. 3 are depicted in the neutral position but are movable to one of two work positions designated as the A or B positions.

In FIG. 3, pump 96 is actually formed of three hydraulic fluid pumps connected along three fluid source lines to the valve stacks 120 and 126. FIG. 3 also shows operator input devices, which are depicted as joysticks 40A and 40B. Joystick 40A is preferably a right hand joystick located on the right hand side of seat 34, while joystick 40B is a left hand joystick located on the left hand side of seat 34. Joystick 40A is operable, based upon its position, to provide a pilot pressure to bucket valve 106 and arm valve 122. Joystick 40B is operable, depending on its position, to provide pilot pressure to boom valve 128 and slew valve 102. A pressure reducing valve arrangement 136 is also coupled to pumps 96. Pressure reducing valve arrangement 136 reduces the pressure of the hydraulic fluid provided by pumps 96 and provides it to joysticks 40A and 40B. This pressure reduction is necessary to reduce the pressure to an appropriate pilot pressure used to actuate the various valves actuated by joysticks 40A and 40B. Tank 98 also has an associated filter and bypass arrangement 138 which includes a fluid filter and a high pressure bypass line. Tank 98 also has an associated hydraulic fluid cooler 140.

In the preferred embodiment, slew valve 102, which controls slew motor 118, is coupled in series with the parallel combination of blade valve 104, boom offset valve 108, arm valve 122 and boost valve 124. Therefore, when slew valve 102 is in the neutral position shown in FIG. 3, the hydraulic fluid under pressure provided by pump 96 simply passes through valve 102 to the parallel combination of valves 104, 108, 122 and 124. However, when the operator manipulates joystick 40B to actuate the slew motor such that valve 102 moves to either position A or position B, hydraulic fluid under pressure is provided through valve 102 to slew motor 118 causing rotation of operator support portion 14 relative to base 12. The direction of rotation depends upon whether valve 102 is in position A or position B.

In either case, the hydraulic fluid under pressure provided to slew motor 118 is returned to valve 102 after it circulates through motor 118. This hydraulic fluid under pressure is then passed through valve 102 to the parallel combination of valves 104, 108, 122 and 124. Therefore, all of the hydraulic fluid under pressure provided to valve 102, regardless of whether it is diverted to slew motor 118, is available to the parallel combination of valves 104, 108, 122 and 124 for actuation of any of the cylinders associated with those valves.

This means that the operator can slew operator compartment 14 while still actuating blade cylinder 24, boom offset cylinder 47, or arm cylinder 68. When any of those cylinders are actuated, the hydraulic fluid under pressure is provided to the appropriate cylinder and hydraulic fluid is removed from the opposite side of that cylinder and diverted to tank 98.

FIG. 3 also shows that a similar technique to that used to for valve stack 120 is also used in valve stack 126. In other words, the hydraulic fluid under pressure provided by pumps 96 is first provided to the valves which control the hydraulic travel motors 114 and 116. Therefore, after the hydraulic fluid travels through motors 114 or 116, it is returned to the appropriate valve 130 and 132 and made available to hydraulic control valves downstream of that valve. In other words, the hydraulic fluid which is provided from valve 130 to right hand travel motor 114 is returned to valve 130, after it circulates through motor 114, and is made available to boom valve 128 so that the boom cylinder 56 can be actuated while the right hand travel motor 114 is also moving. Similarly, the hydraulic fluid under pressure which is provided through left hand travel valve 132 to left hand travel motor 116 is returned to valve 132, after it circulates through motor 116, and is thus made available to valves 106 and 134 which are located downstream of left hand travel valve 132. Therefore, the bucket cylinder 83, or an auxiliary implement coupled to auxiliary valve 134, can also be actuated even while left hand travel motor 116 is running.

By arranging either or both of valve stacks 120 and 126 according to the present invention, at least four functions can be simultaneously obtained even though only three pumps are used. This allows more efficient operation of mini-excavator 10 without the significant hardware cost involved in adding and plumbing another pump 96. Further, by using the cross-port relief valves already found in slew motor 118 and travel motors 114 and 116, the present invention can be implemented substantially without the use of any additional hardware. In addition, it does not matter whether the cross-port relief valves are actuated. The over pressure hydraulic fluid is still channeled to the remainder of the valves located downstream of the hydraulic motors.

Valve stack 120 also includes a power beyond feature and a boost feature. In the event that none of the hydraulic cylinders 104, 108 or 122 are actuated, or in the event that any of those valves are actuated but there is excess hydraulic fluid flow available, that hydraulic fluid flow passes to boost valve 124. If boost valve 124 is controlled to remain in its neutral position, any hydraulic fluid reaching boost valve 124 is diverted to auxiliary valve 134 and bucket valve 106. This places the outputs from two pumps in a configuration to service the auxiliary valve 134 and the bucket valve 106. This, in contrast to prior mini-excavators, allows the auxiliaries to substantially always be active.

Further, if the operator manipulates joystick 40A to place boost valve 124 in position A, any excess hydraulic fluid that reaches boost valve 124 is provided to the base end of boom cylinder 56. Thus, this hydraulic fluid flow is provided to aid the extension of boom cylinder 56 to raise boom 52. Since the boom cylinder 56 is a relatively large cylinder, a great deal of oil must be provided to cylinder 56 in order to raise boom 52. This can be a fairly time consuming process. Therefore, the boost valve 124 according to the present invention provides additional hydraulic fluid to the base of boom cylinder 56 in order to increase the speed of the lifting operation.

Also, if the operator moves boost valve 124 to position B, then any excess hydraulic fluid which reaches valve 124 is diverted to the left and right hand travel motors through valves 132 and 130, respectively. The hydraulic fluid from boost valve 124 to the left and right hand travel motors is simply provided through a pair of check valves 125 and 127. Therefore, the excess hydraulic fluid reaching boost valve 124 is made available to the travel motors 114 and 116 to increase the travel speed of mini-excavator 10.

Boost valve 124 is thus actuable between two positions to provide excess hydraulic fluid to boost the operation of one of two hydraulic functions. Since only a single valve is used to boost one of two hydraulic functions, boost valve 124 provides an effective method of increasing the efficiency of mini-excavator 10 without a great deal of excess hardware.

Another feature of implementing boost valve 124 increases the fluid metering resolution. There are typically two ways in which valve spools are stroked. The first is to mechanically push or pull on a tang which protrudes from the valve with a cable or other mechanical linkage. This type of spool is referred to as a manually operated valve spool. The second is to connect a low pressure hydraulic line (the pilot pressure) to stroke the spool hydraulically. This is referred to as a hydraulically actuated spool. In the embodiment shown in FIG. 3, the valve spools are hydraulically actuated using low pilot pressure from pressure reducing valve 136 through joysticks 40A and 40B. In the preferred embodiment, boost valve 124 is regulated to actuate at a predetermined pilot pressure, different from the pilot pressure which actuates the boosted valve spools, to achieve desired operation.

For instance, it would not be desirable to immediately dump all of the boost fluid from boost valve 124 into the boosted actuator at the beginning of actuation of the boosted actuator. This would result in an inability to obtain fine metering of the oil, and could result in rough operation of the boosted cylinder. Therefore, boost valve 124 is typically configured so that it will not be actuated until the pilot pressure actuating the spool in the valve controlling the boosted actuator reaches a predetermined level.

By way of example, the pilot pressure provided to boom valve 128 in order to initially actuate boom valve 128 may typically be 80 psi. Therefore, when the pilot pressure reaches 80 psi, hydraulic fluid begins to flow out of one of the work ports of valve 128 into either the rod or base of boom cylinder 56. In that instance, boost valve 124 is configured so the pilot pressure to boost valve 124 must be greater than 80 psi before boost valve 124 will begin diverting hydraulic fluid to boom cylinder 56. In the preferred embodiment, where boom valve 128 is actuated starting at 80 psi, boost cylinder 124 is configured so that it will not begin diverting hydraulic fluid to boom cylinder 56 until the pilot pressure reaches 125 psi. Also, boom cylinder 128 may typically require 300 psi of pilot pressure before the valve is fully stroked. In that instance, boost valve 124 is configured so that 300 psi also corresponds to valve 124 being fully stroked. Therefore, in operation, the operator will move joystick 40B so that it provides 80 psi to boom valve 128 and boost valve 124. This causes boom valve 128 to begin to provide hydraulic fluid under pressure to boom cylinder 56, while boost valve 124 remains closed. As the operator continues to move joystick 40B such that the pilot pressure to boom valve 128 increases to 125 psi, boom valve 128 will provide more hydraulic fluid to boom cylinder 56 and boost valve 124 will just then begin to provide hydraulic fluid under pressure to boom cylinder 56. As the operator continues to move joystick 40B to increase the pilot pressure to boom valve 128 and boost valve 124, both valves open further and provide additional hydraulic fluid to boom cylinder 56. This continues until 300 psi of pilot pressure is provided to boom valve 128 and boost valve 124 at which point both valves are fully stroked and provide full hydraulic fluid under pressure to boom cylinder 56.

In the preferred embodiment, the boost valve 124 is used to boost either the boom lift function, or the travel speed function. While this is only the preferred embodiment, it has been found to be quite practical since a boom boost operation is typically not desired when mini-excavator 10 is travelling, and when mini-excavator 10 is digging, it is typically not traveling. However, it should be noted that additional boost valves can be used to boost other operations, or boost valve 124 can be reconfigured to boost any other desired operation, other than travel or the boom raising function.

While the present invention is illustrated in an open center system using three individual fixed displacement pumps, it could also be implemented in a closed center system as well.

Figure 4A:
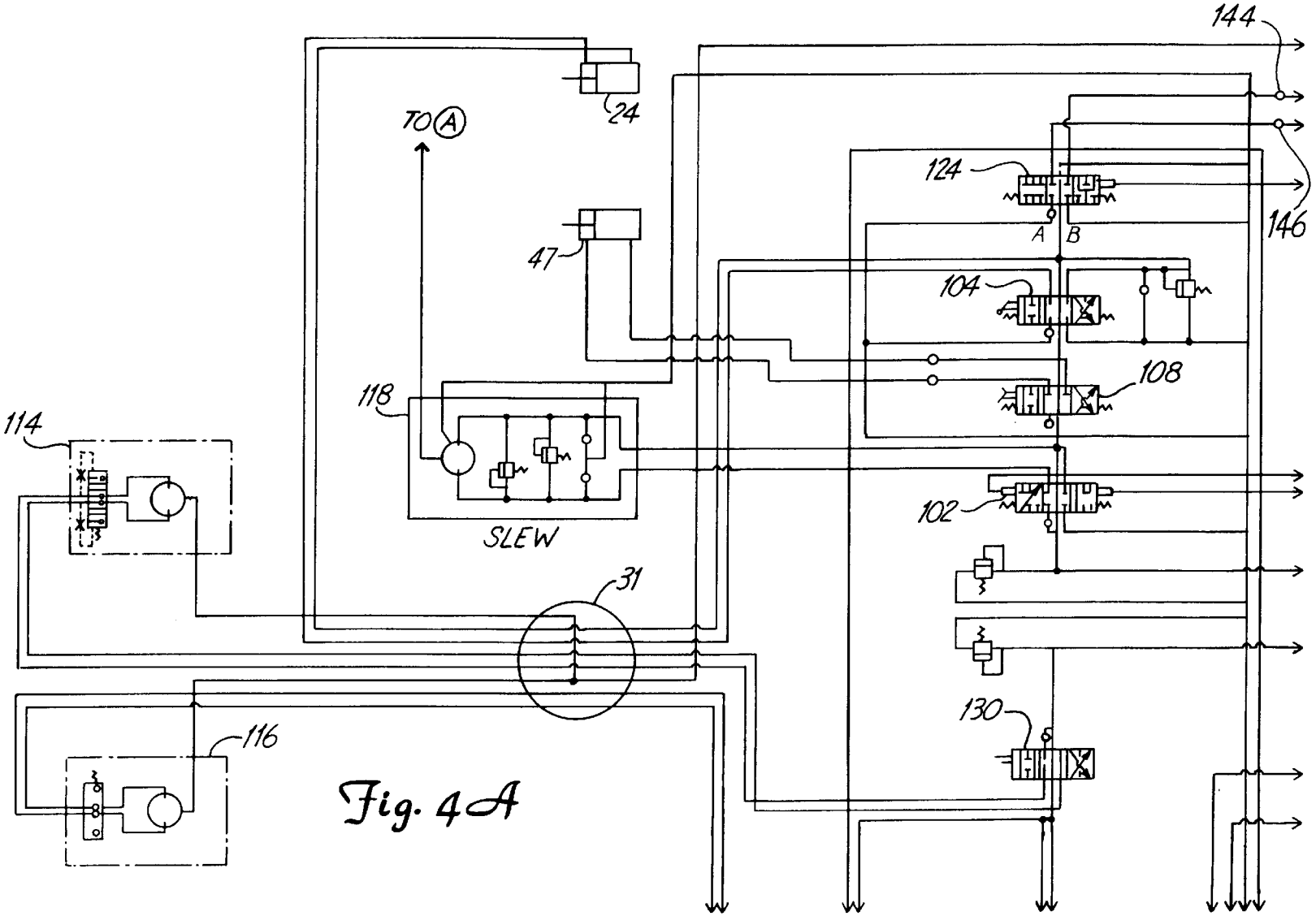
FIG. 4 is a more detailed schematic diagram of a second embodiment of a hydraulic system according to the present invention.
Figure 4B:
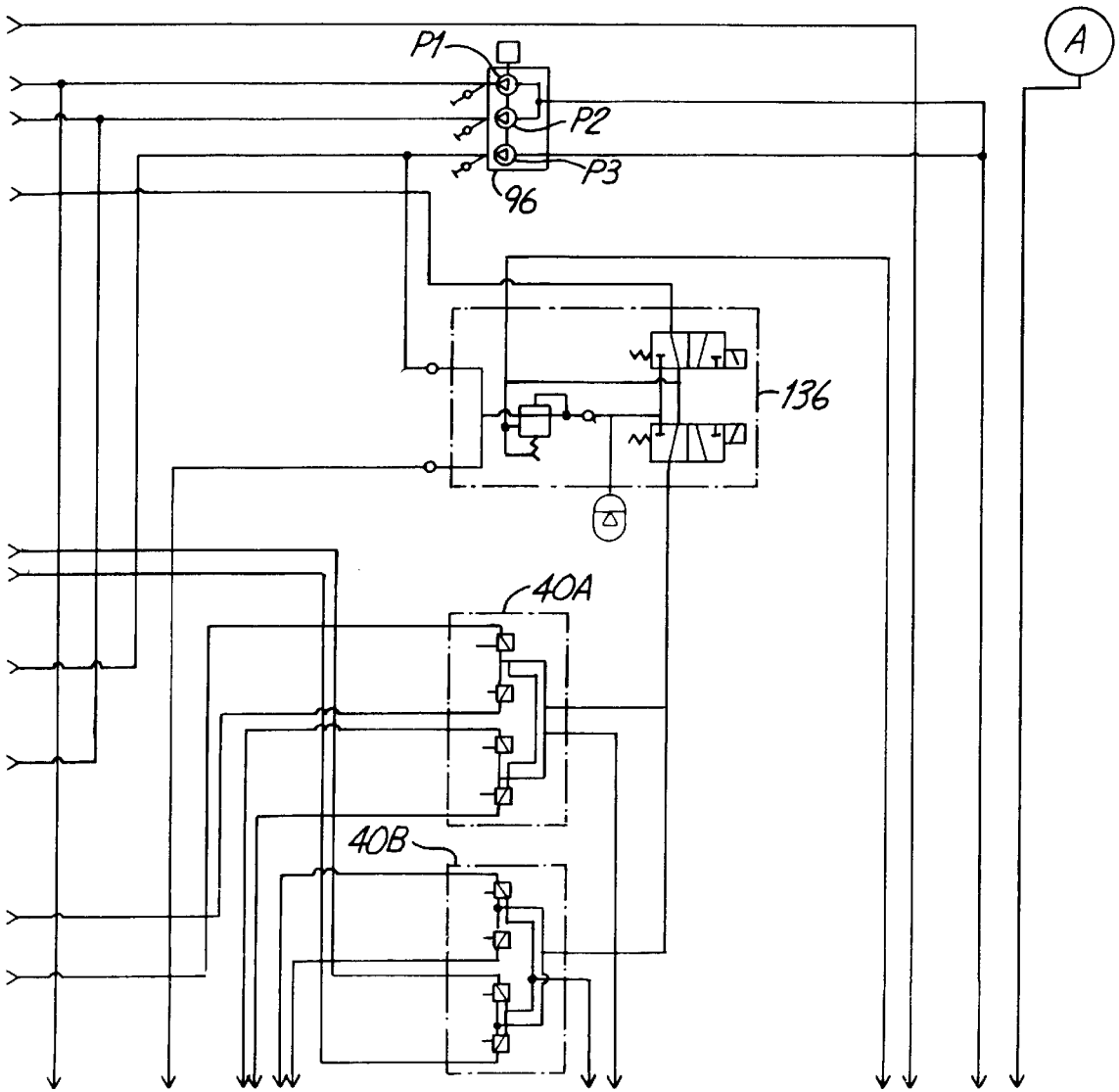
Figure 4C:
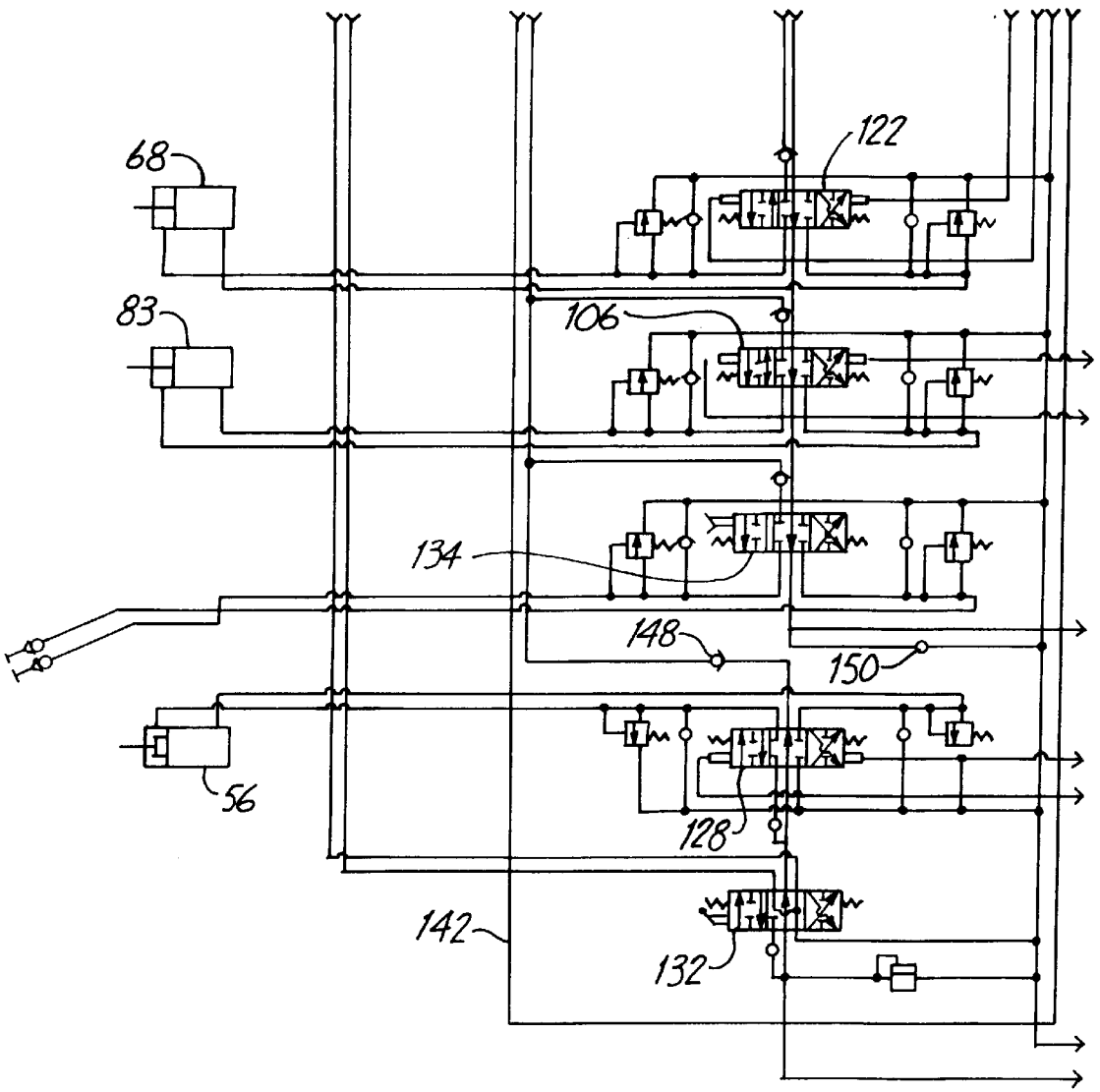
Figure 4D:
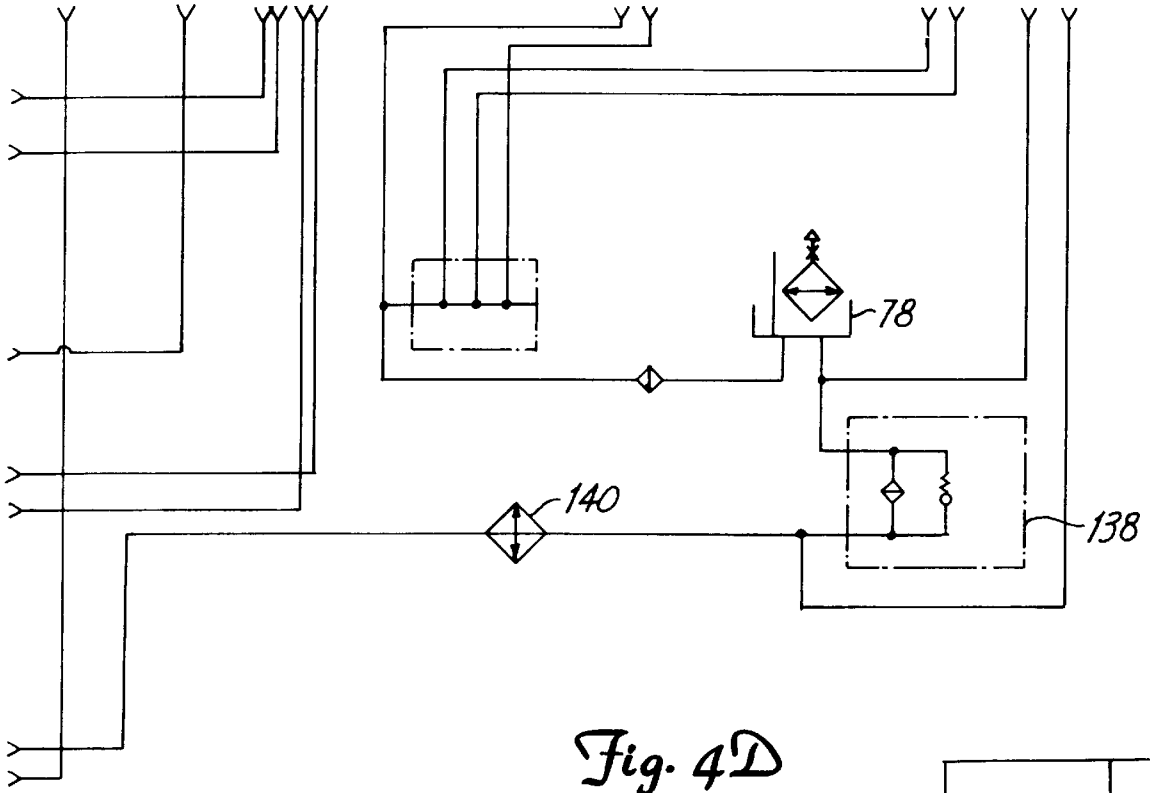
Figure 4:
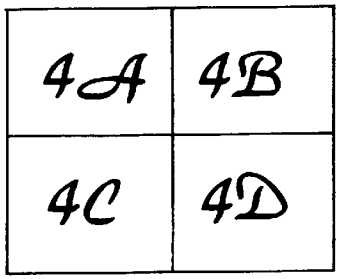

FIG. 4 is more detailed block diagram of a second embodiment of a hydraulic power circuit according to the present invention. Similar items to those shown in FIG. 3 are similarly numbered.

In FIG. 4, there are a number of differences from the system shown in FIG. 3. The valves in FIG. 4 are shown as, in one preferred embodiment, a single physical valve stack 142. Also, pump 96 shown in FIG. 4 has the three hydraulic pumps individually labeled P1, P2 and P3. In the preferred embodiment, pumps P1 and P2 are five cubic centimeter pumps while pump P3 is a ten cubic centimeter pump. Pump P1 is coupled to provide hydraulic fluid to left hand travel valve 132. As in FIG. 3, left hand travel valve 132 is coupled in series with other valves in the valve stack. In FIG. 4, left hand travel valve 132 is coupled to boom valve 128. Therefore, the hydraulic fluid provided to left hand travel motor 116 through valve 132 is also available to boom valve 128 so that it can be provided to boom cylinder 56. This allows boom cylinder 56 to be operated except during travel. If the hydraulic fluid provided to boom valve 128 is not used by boom cylinder 56, it is provided as additional hydraulic fluid to a parallel combination of auxiliary valve 134, bucket valve 106 and arm valve 122.

The parallel combination of these three valves receives primary hydraulic fluid flow from pump P2. Pump P2 provides its output to right-hand travel valve 130. As with left-hand travel valve 132, right-hand travel valve 130 is coupled to other valves in valve stack 142. Therefore, hydraulic fluid which is not used by right-hand travel motor 114 is available to the parallel combination of arm valve 122, bucket valve 106 and auxiliary valve 134, such that one of those functions can be operated.

Therefore, if boom cylinder 56 is not being actuated, the hydraulic fluid from both pumps P1 and P2 is available to the parallel combination of valves 122, 106 and 134. Further, even if boom cylinder 56 is being actuated, hydraulic fluid is still available to power the parallel combination of valves 122, 106 and 134. This has a significant advantage over prior systems which place boom valve 128 and bucket valve 106 in parallel. In that instance, only one of those two functions can be operated at a time. However, with the configuration shown in FIG. 4, both the boom cylinder 56 and the bucket cylinder 83 can be operated simultaneously. Alternatively, the boom cylinder 56 and either the arm cylinder 68 or the auxiliary function can also be operated at the same time.

In the preferred embodiment, right-hand travel valve 130 and left-hand travel valve 132 are placed in a position such that they always have priority. In other words, the hydraulic fluid from pump 96 reaches these valves before it can be diverted to tank by any other functions. However, the hydraulic circuit providing hydraulic fluid to the travel motors is not isolated from the remaining functions. Instead, the valves associated with the travel motors are simply connected to other functions so that the hydraulic fluid unused by the travel motors is also available to operate other functions. This provides significant additional functionality in the excavator 10 over prior hydraulic systems, without the need for providing additional hydraulic pumps.

FIG. 4 also shows that (as shown in FIG. 3) slew valve 102, which is connected to slew motor 118, is connected in series with other valves in valve stack 142. In the embodiment shown in FIG. 4, slew valve 102 is connected in series with the parallel combination of boom offset valve 108 and blade valve 104. Therefore, the hydraulic fluid provided to slew motor 118 is also available to power the boom offset function or the blade function. This has been found to be advantageous where excavator 10 is being manipulated around, or near, an immovable object. It has been found that the ability to operate both slew motor 118 and boom offset cylinder 47 simultaneously is desirable from an operator standpoint because it provides improved functionality.

Further, boost cylinder 124 is also provided (in one preferred embodiment) as part of the parallel combination of boom offset valve 108 and blade valve 104. Therefore, any hydraulic fluid which is not used by the boom offset and blade functions is available to boost valve 124. When boost valve 124 is actuated (moved to the B work position shown in FIG. 4), the hydraulic fluid available to boost valve 124 is effectively added to the flow provided at the output of pumps P1 and P2. Pump P3 (which provides hydraulic fluid to slew valve 102, boom offset valve 108, blade valve 104 and boost valve 124) is preferably sized twice that of pumps P1 and P2 (e.g., pumps P1 and P2 are 5 cc per revolution pumps and pump P3 is a 10 cc per revolution pump). Therefore, the hydraulic fluid added to the outputs of pumps P1 and P2 by boost valve 124 effectively doubles the output provided to right-hand travel motor 130 and left-hand travel motor 132. In other words, in the B work position both of the work ports of valve 124 are coupled together to receive hydraulic fluid provided at the input of valve 124. Those work ports are correspondingly provided through a pair of check valves 144 and 146 to add to the outputs of pumps P1 and P2. Thus, the total flow to each travel motor doubles from 5 cc/rev to 10 cc/rev. This configuration is substantially at odds with conventional wisdom which provides that the hydraulic power circuits for the travel motors should be kept substantially separate. Yet, by configuring the hydraulic system as described in accordance with this feature of the present invention, the travel speed of the machine can be doubled without the need for providing a dual-displacement travel motor. In addition, the increased speed is accomplished without the lower output torque associated with dual-displacement motors.

Check valves 144 and 146 are provided because both work ports of valve 124 are connected together when valve 124 is actuated. If check valves 144 and 146 were not provided, and if the operator only actuated one of the travel valves 130 or 132, then the pressure from all pumps would flow backward through valve 124, through the non-actuated travel valve 130 or 132, and to tank. Thus, no pressure would be built and the machine would not move. However, by placing check valves 144 and 146 in the circuit, both work ports of valve 124 can be connected together. Even if the operator actuates only one of the travel valves 130 or 132, the machine still moves, it just moves more slowly than otherwise.

It is also worth nothing another feature according to the present invention. All of the valves 102, 104, 106, 108, 124, 128, 130, 132 and 134 are in a single physical valve stack. This arrangement provides a more efficient system because manufacturing is made easier, and less costly. Further, since the valves are in one physical valve stack 142, all of the valves have a common tank galley or tank pathway. This reduces the amount of plumbing needed to implement the circuit. Rather than requiring the connection of two separate tank galleys to the system tank, connection of only one tank galley is required.

In order to accomplish this, isolation check valve 148 and pressure build-up valve 150 are provided in the same physical block. Isolation check valve 148 ensures that hydraulic fluid only flows in one direction from boom valve 128. That is, the hydraulic fluid unused by boom cylinder 56 only flows into the parallel combination of valves 106, 122 and 134, and does not flow in a reverse direction through check valve 148.

Build-up valve 150 is provided to facilitate operation of the system upon, for example, start-up. Upon start-up of excavator 10, there may not be enough back pressure in the hydraulic power circuit to provide a pilot pressure to close any valves in the circuit. Therefore, the hydraulic fluid in the system simply proceeds unrestricted to tank. That being the case, no back pressure is developed in the system and the valves do not operate. By providing build-up valve 150, this ensures that there is at least a minimum amount of back pressure in the system such that joysticks 40A and 40B have an input pressure which is high enough to provide the necessary output pilot pressure to manipulate the valves in the system.

It should also be noted that, in the preferred embodiment, build-up valve 150 is arranged such that, when all of the valves are in the open-center position, build-up valve 150 receives hydraulic fluid from both pumps P1 and P2. Thus, the necessary back pressure builds more quickly.

It can be seen that the present invention provides significant advantages over prior systems by providing hydraulic fluid to the boom valve by one pump and providing hydraulic fluid to the parallel combination of the arm valve and bucket valve by another pump. This allows desired functionality of excavator 10. In addition, while the valves are configured in this way, the left and right hand travel valves 132 and 130, respectively, receive hydraulic fluid from the pumps on a priority basis. Therefore, the travel function has priority over the other functions and can be performed in addition to other functions. Further, it can be seen that the slew motor is provided in series with the boom offset (or boom swing) function so that both of those functions can be performed at the same time. Another feature of the present invention provides that, by actuation of boost valve 124, the flow of all three pumps are combined and made available to the travel motors. Since the pump which is eventually combined through the boost valve is larger than the other two pumps (in a preferred embodiment it is twice as large as the other two pumps) the travel speed of the excavator can be substantially increased when the boost valve is actuated, without the requirement of providing a multiple-displacement motor. The higher speed is provided without sacrificing torque.

In addition, the valves are provided in a single valve stack with the isolation check valve 148 and the build-up valve 150 provided in close proximity so that the amount of plumbing in a hydraulic power circuit is reduced over prior systems.

Although the present invention has been described with reference to preferred embodiments, workers skilled in the art will recognize that changes may be made in form and detail without departing from the spirit and scope of the invention.

What is claimed is:

1. A power machine, comprising a base;

a boom coupled to the base;

a hydraulic boom actuator coupled to the boom to move the boom relative to the base;

an arm coupled to the boom;

a hydraulic arm actuator coupled to the boom and the arm to move the arm relative to the boom;

a tool coupled to the arm;

a tool actuator coupled to the tool to move the tool relative to the arm;

a traction actuator coupled to the base to drive the power machine;

a hydraulic power circuit including a first pump providing hydraulic fluid under pressure and a second pump providing hydraulic fluid under pressure;

a traction valve mechanism coupled to the traction actuator to receive hydraulic fluid under pressure from one of the first and second pumps and selectively provide the hydraulic fluid to the traction actuator;

a boom valve coupled to the first pump and to the boom actuator to receive hydraulic fluid under pressure from the first pump and selectively provide the hydraulic fluid to the boom actuator;

an arm valve coupled to the second pump and the arm actuator to receive hydraulic fluid under pressure from the second pump and selectively provide the hydraulic fluid to the arm actuator; and a tool valve coupled in parallel with the arm valve and to the tool actuator to receive hydraulic fluid under pressure from the second pump and selectively provide the hydraulic fluid to the tool actuator;

wherein at least one of the boom valve and the parallel connected arm valve and tool valve are coupled down stream of, and in series with, the traction valve mechanism.

2. The power machine of claim 1 wherein the traction actuator comprises:

a first traction motor; and wherein the traction valve mechanism comprises:

a first traction valve coupled to the first traction motor and coupled between the boom valve and the first pump, the first traction valve selectively providing hydraulic fluid from the first pump to the first traction motor.

3. The power machine of claim 2 wherein the traction actuator further comprises: a second traction motor; and wherein the traction valve mechanism comprises:

a second traction valve coupled to the second traction motor and coupled between the second pump and the parallel connected arm valve and tool valve, and the second traction valve selectively providing hydraulic fluid from the second pump to the second traction motor.

4. The power machine of claim 3 wherein the hydraulic power circuit includes a third pump providing hydraulic fluid under pressure, and further comprising:

a boost valve coupled to receive hydraulic fluid from the third pump and coupled to the first and second traction valves to selectively provide hydraulic fluid from the third pump to the first and second traction valves such that the first traction valve receives hydraulic fluid from the first and third pumps and the second traction valve receives hydraulic fluid from the second and third pumps.

5. The power machine of claim 4 wherein the third pump has a larger capacity than the first and wherein the third pump has a larger capacity than the second pump.

6. The power machine of claim 5 and further comprising:

an operator support portion coupled to the base;

a hydraulic slew motor coupled to move the operator support portion relative to the base; and a slew valve coupled to the third pump and coupled in series with at least one additional power actuator valve to receive the hydraulic fluid under pressure from the third pump and coupled to the slew motor to selectively provide hydraulic fluid to the slew motor.

7. The power machine of claim 6 and further comprising a boom offset cylinder coupled to the boom to pivot the boom relative to the base portion and wherein the at least one additional power actuator valve comprises a boom offset valve coupled to the boom offset cylinder to selectively provide hydraulic fluid to the boom offset cylinder, the boom offset valve being coupled down stream of the slew valve.

8. The power machine of claim 1 wherein the parallel-connected tool valve and arm valve are coupled down stream of the boom valve to receive hydraulic fluid from the first pump which is not diverted to the boom actuator by the boom valve, and further comprising:

a pressure build-up valve coupled down stream of the parallel-connected tool valve and arm valve, the pressure build-up valve impeding hydraulic fluid flow from the first and second pumps to tank until a fluid pressure threshold is reached.

9. An excavator, comprising:

a base;

a first drive mechanism coupled to the base;

a first traction motor coupled to drive the first drive mechanism;

a second drive mechanism coupled to the base;

a second drive motor coupled to drive the second drive mechanism;

a hydraulic power circuit including a first pump providing hydraulic fluid under pressure, a second pump providing hydraulic fluid under pressure, and a third pump providing hydraulic fluid under pressure, and further comprising:

a first traction valve coupled to the first pump and the first drive motor to selectively provide the hydraulic fluid from the first pump to the first drive motor;

a second traction valve coupled to the second pump and the second drive motor to selectively provide the hydraulic fluid from the second pump to the second drive motor; and a boost valve coupled to the third pump and to the first and second drive motors to selectively provide the hydraulic fluid from the third pump to the first and second drive motors.

10. The excavator of claim 9 and further comprising:

a first check valve coupled between the boost valve and the first drive motor; and a second check valve coupled between the boost valve and the second drive motor.

11. The excavator of claim 9 wherein the third pump has a larger capacity than the first and second pumps.

12. The excavator of claim 9 and further comprising:

a boom coupled to the base;

a hydraulic boom actuator coupled to the boom to move the boom relative to the base; and a boom valve coupled to the first traction valve and coupled to the boom actuator to receive hydraulic fluid under pressure from the first pump through the first traction valve and selectively provide the hydraulic fluid to the boom actuator.

13. The excavator of claim 12 and further comprising:

an arm coupled to the boom;

a hydraulic arm actuator coupled to the boom and the arm to move the arm relative to the boom;

a tool coupled to the arm;

a tool actuator coupled to the tool to move the tool relative to the arm;

an arm valve coupled to the second pump and the arm actuator to receive hydraulic fluid under pressure from the second pump and selectively provide the hydraulic fluid to the arm actuator; and a tool valve coupled in parallel with the arm valve and to the tool actuator to receive hydraulic fluid under pressure from the second pump and selectively provide the hydraulic fluid to the tool actuator.

14. The excavator of claim 13 wherein the parallel-connected arm valve and tool valve are connected down stream of the boom valve such that hydraulic fluid from the first pump which is not diverted to the boom actuator is provided to the parallel-connected arm valve and tool valve.

15. The excavator of claim 9 and further comprising:

an operator support portion coupled to the base;

a hydraulic slew motor coupled to move the operator support portion relative to the base; and a slew valve coupled to the third pump and coupled upstream of the boost valve and in series with the boost valve and coupled to the slew motor to selectively provide hydraulic fluid from the third pump to the slew motor.

16. The excavator of claim 15 and further comprising:

a boom offset cylinder coupled to the boom to pivot the boom relative to the base; and a boom offset valve coupled to the boom offset cylinder and coupled in parallel with the boost valve to selectively provide hydraulic fluid to the boom offset cylinder.

17. The excavator of claim 16 wherein the first and second traction valves, the boom valve, the arm valve and the bucket valve are all formed in a single physical valve stack.

18. An excavator, comprising:

a base;

a first drive mechanism coupled to the base;

a first traction motor coupled to drive the first drive mechanism;

a second drive mechanism coupled to the base;

a second drive motor coupled to drive the second drive mechanism;

a hydraulic power circuit including a first pump providing hydraulic fluid under pressure, a second pump providing hydraulic fluid under pressure, and a third pump providing hydraulic fluid under pressure; and a valve configuration coupled to the first, second and third pumps to selectively provide hydraulic fluid from the first pump to the first drive motor, from the second pump to the second drive motor and from the third pump to both the first and second drive motors.

19. The excavator of claim 18 wherein the first, second and third pumps each have a pump outlet providing the hydraulic fluid, and wherein the valve configuration comprises:

a first traction valve having an inlet and an outlet, the inlet being operatively coupled to the first pump and the outlet being operatively coupled to the first drive motor to selectively provide the hydraulic fluid from the first pump to the first drive motor;

a second traction valve having an inlet and an outlet, the inlet being operatively coupled to the second pump and the outlet being operatively coupled to the second drive motor to selectively provide the hydraulic fluid from the second pump to the second drive motor; and a boost valve having an inlet and an outlet, the inlet being operatively coupled to the third pump and the outlet being coupled for one-way fluid communication with the outlets of the first and second pumps to selectively provide the hydraulic fluid from the third pump to the first and second drive motors.

20. The excavator of claim 19 wherein the outlet of the boost valve is coupled for fluid communication with the outlets of the first and second pumps through first and second check valves, respectively.

* * * * *